US005582342A

United States Patent [19]

Jud

[11] Patent Number: 5,582,342

[45] Date of Patent: Dec. 10, 1996

[54] TEAR-OFF PACKAGE WITH PULL-TAB

[75] Inventor: Wilfried Jud, Pölten, Austria

[73] Assignee: Teich Aktiengesellschaft, Austria

[21] Appl. No.: 392,746

[22] PCT Filed: Jul. 7, 1994

[86] PCT No.: PCT/AT94/00086

§ 371 Date: Mar. 8, 1995

§ 102(e) Date: Mar. 8, 1995

[87] PCT Pub. No.: WO95/01922

PCT Pub. Date: Jan. 19, 1995

[30] Foreign Application Priority Data

Jul. 8, 1993 [AT] Austria ..... 1347/93

[51] Int. Cl.[6] ..... B65D 65/10; B65D 65/14; B65D 65/30; B65D 65/32

[52] U.S. Cl. ..... 229/87.05; 229/926; 383/205

[58] Field of Search ..... 229/87.05, 926; 383/205

[56] References Cited

U.S. PATENT DOCUMENTS

| | | | |
|---|---|---|---|
| 2,337,741 | 12/1994 | Clemente | 229/926 |
| 3,426,936 | 2/1969 | Palmer | 383/205 |
| 3,497,131 | 2/1970 | Tracy . | |
| 4,053,046 | 10/1977 | Roark | 229/87.05 |
| 4,638,911 | 1/1987 | Prohaska | 383/205 |
| 4,657,142 | 4/1987 | Mitzoguchi et al. . | |
| 4,811,848 | 3/1989 | Jud | 383/205 |
| 5,184,771 | 2/1993 | Jud et al. | 229/87.05 |
| 5,356,068 | 10/1994 | Moreno | 229/926 |

FOREIGN PATENT DOCUMENTS

| | | | |
|---|---|---|---|
| 0339420A1 | 11/1990 | European Pat. Off. . | |
| 785431 | 8/1935 | France | 229/87.05 |
| 3836227A1 | 4/1990 | Germany . | |
| 164704 | 10/1933 | Switzerland . | |
| 2123376 | 2/1984 | United Kingdom . | |

*Primary Examiner*—Stephen P. Garbe
*Attorney, Agent, or Firm*—Bacon & Thomas

[57] ABSTRACT

In a package, especially a pouch package, with a covering made of a flat foldable packaging material in which the inner sides of two strip-like edge regions are sealed together in a joining region to form the covering, there is a strip-like tear region in the package covering which starts from one of the two strip-like edge regions, extends substantially prependicularly thereto and has notches or linear punched-out regions only within the strip-like edge region. Here, at the beginning of the rear region between the two strip-like edge regions, there is a tab of flat material which is firmly secured to the edge region from which the tear region starts and is secured detachably or not at all to the other edge region, while the remainder of the flat of the tab projects beyond the edge of the edge region.

18 Claims, 4 Drawing Sheets

TEAR-OFF PACKAGE WITH PULL-TAB

TECHNICAL FIELD

The invention concerns a packaging with a sleeve composed of a flat and foldable packaging material of which two strip edge-zones are sealed together in a junction area, in particular along their inside surfaces, to form said sleeve, such packaging for instance being a tubular pouch, a strip-shaped tear-open zone of the packaging sleeve extending from one of the two strip edge-zones and essentially perpendicularly to said edge zone and comprising notches or linear perforations at its lateral boundaries or only inside the strip-shaped edge zone.

STATE OF THE ART

Packaging of this kind is known from the patent document WO 91/06488 which furthermore also describes the selection of multi-layer packaging materials which, during the opening procedure, for instance when starting from two cuts in an edge zone of the packaging material, that will tear along two approximately parallel lines. The German patent document 38 36 227 A1 furthermore describes a packaging of the initially cited kind wherein the packaging material is constituted by a splicing foil. This foil is a plastic stretched along a single axis and which, beginning at a cut or notch, practically always tears in the direction of stretching. These known packagings are fitted at the beginning of the tear-open zone with a gripping tab formed by part of the edge zones of the packaging material between the notches or the linear perforations.

The said patent document WO 91/06484 also describes several solutions wherein an unsealed area remains between the junction area and the free edge of the edge zones, said unsealed area forming the gripping tab between the two notches or the linear perforations. A tradeoff is required in this design between the gripping tab being of minimal size for good handling and the unsealed area being sufficiently narrow to save material.

DISCUSSION OF THE INVENTION

The object of the invention is to create a packaging of the initially cited kind which comprises a gripping tab easily recognized and handled without thereby incurring a significant increase in material consumption.

The problem basic to the invention is solved by the packaging of the invention which is characterized in that a flat gripping tab is mounted by part of its area at the beginning of the tear-open zone between the two strip-shaped edge zones, this gripping tab being solidly joined to the edge zone where the tear-open zone starts while being detachable or unattached with the other edge zone, said tab by its remaining area projecting beyond the edge of that edge zone where the tear-open zone begins. Advantageously the gripping tab may be narrower than the tear-open zone.

In an advantageous embodiment of the invention, the gripping tab is wider than the tear-open zone and moreover is detachable from the edge zone where the tear-open zone starts.

In a further advantageous embodiment of the invention, the linear perforations in that edge zone where the tear-open zone begins stop short of the free edge of said edge zone.

In further advantageous embodiments of the packaging of the invention, the adhesion of the sealing of the connection zone is less on the average within the tear-open zone than in the remainder of the junction area, and for that purpose the sealing may assume the form of a grid of lines especially within the tear-open zone.

In a last advantageous embodiment of the invention, the packaging material is characterized by consisting of several layers selected from the sequence of paper, unstretched polyolefin foil or layer, aluminum foil, a foil of biaxially stretched polyethyleneterephthalate, a foil of biaxially stretched polyamide, and a sub-composite of two or three layers, where called for of the above materials, the particular earlier cited layer in this sequence of all adjoining different layers in the packaging material being nearer the packaged goods and the particular thinner layer of adjoining layers made of the same or similar materials being nearer the packaged good, and where the sub-composite is defined as one with adhesion between its layers which is substantially higher than the adhesion between the sub-composite and the remaining layers of the packaging material.

DETAILED DESCRIPTION OF THE PREFERRED EMBODIMENT

The invention is elucidated below in relation to the Figures, the packaging material being shown exaggeratedly thick for clarity of exposition.

The packaging of the illustrative embodiments below is based on a three-layer packaging material. Beginning with the packaging outside, this packaging material consists for instance of a foil of biaxially stretched polypropylene (OPP) which is 0.015–0.020 mm thick, a printed aluminum foil 0.007–0.009 mm thick and a paper with a specific weight of 40–50 g/m$^2$ and a cross-sectionally deposited hot or cold-seal coating, for instance a latex-based cold seal with 2–7 g/m$^2$ solid. The three layers are joined together conventionally by means of a laminating bonding apparatus.

For each packaging to be made, two cuts are stamped at the packaging machine into a length of packaging material drawn off the roll and immediately thereupon a bonding label forming the gripper tab is deposited on the inside of the length of packaging material. Next the length of packaging material is folded round the continuously supplied packaging goods, for instance waffles, its edges being mutually sealed inside a strip-shaped junction area and the two mutually sealed edge zones—called "crests"—are folded back in such manner on the packaging surface that the edge zone containing the cuts will be located outward. The tube of packaging material enclosing the packaged goods next is provided each time between two consecutive packaged goods with two mutually parallel transverse sealing seams and is subdivided by severing cuts between two transverse sealing seams into individual pouch packages. These cross-seals thereupon form the "fins" of the tubular pouch package away from the packaging sleeve.

Figure 1:
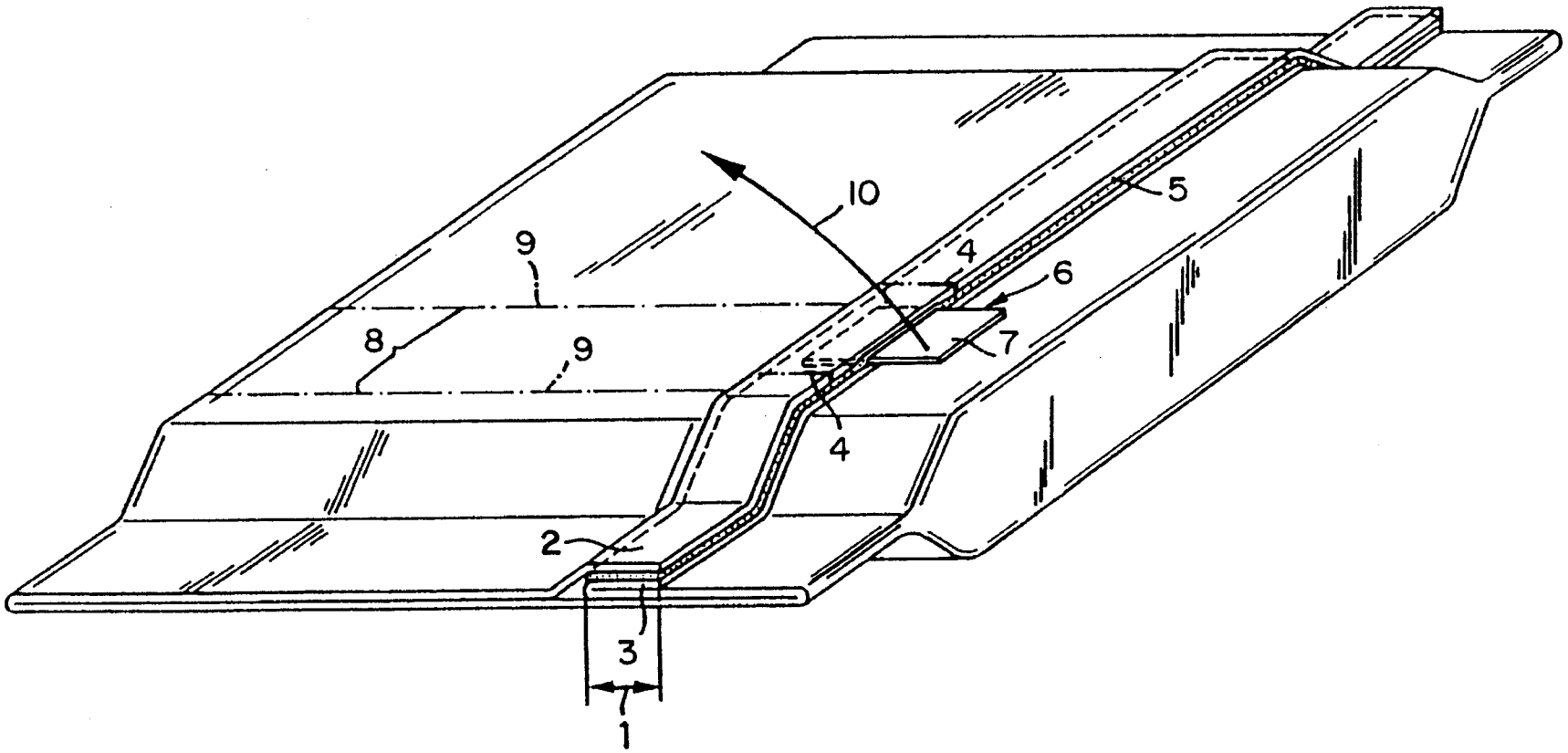
FIG. 1 is a schematic perspective view of a tubular pouch packaging according to the invention.
Figure 1A:
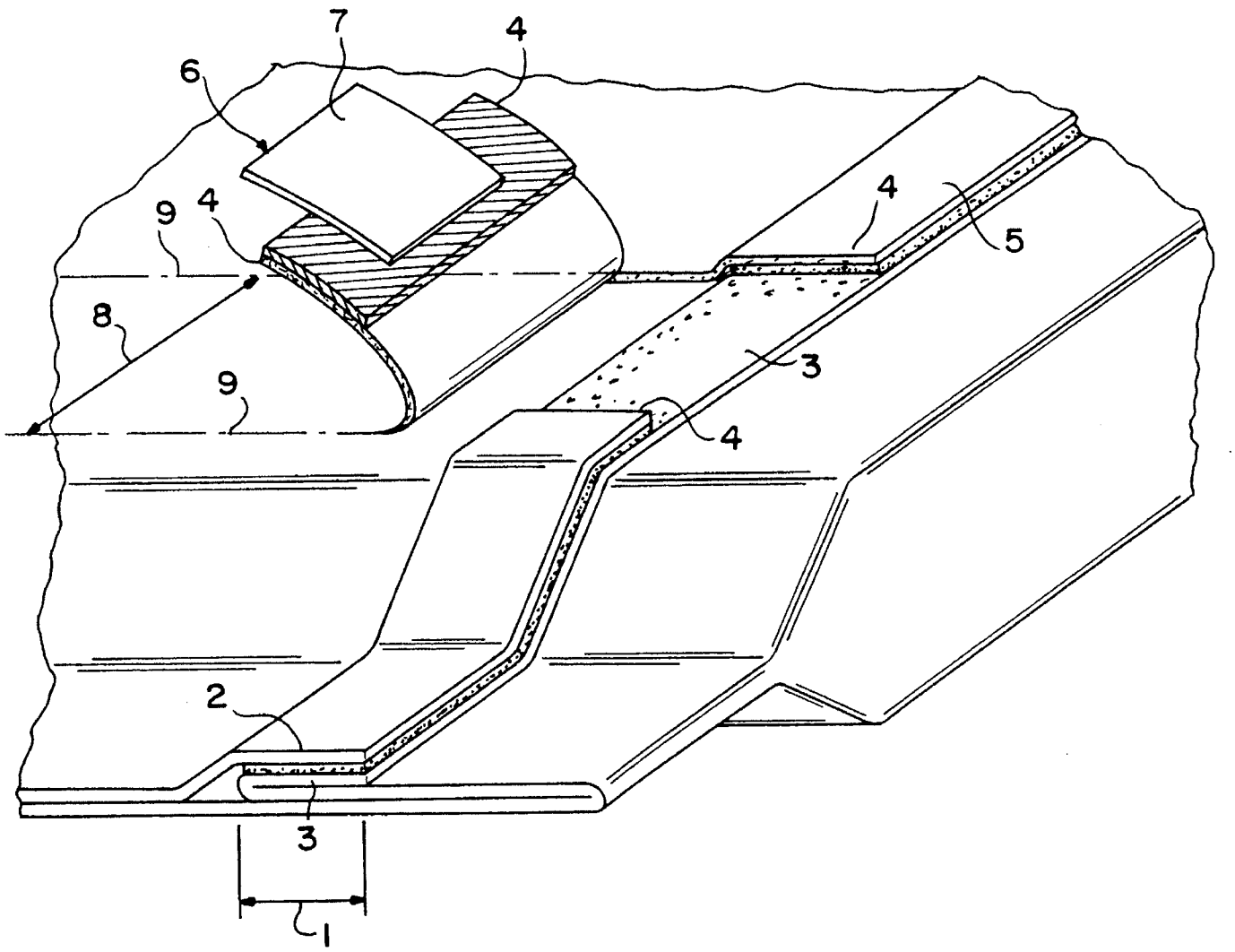
FIG. 1*a* is a partial perspective view of the tubular pouch packaging of FIG. 1 partially torn open.

FIG. 1 is a schematic perspective of a tubular pouch packaging for waffles made in this manner. It shows the packaging-material edge zones 2 and 3 sealed together in a strip-shaped junction area 1 and bent back as the "crest" on the surface of the packaging sleeve. The stamped cuts 4 at the edge zone 2 will be on the outside and run from the edge 5 of the edge zone 2 as far as inside the junction area 1. The bonding tag 6 serving as the gripping tab in this embodiment of FIG. 1 evinces a width less than the spacing between the two cuts 4 and is joined by part of its surface between the two cuts 4 inside the junction area 1 to the edge zone 2, without however occupying the full width of the junction area 1. By the residual part 7 of its surface, the bonding tag 6 projects beyond the edge 3 of the edge zone 2, said part 7 being sufficiently large to be conveniently gripped when opening the package. Advantageously the bonding label consists of a blank of paper or plastic foil, for instance PET or PP, which is fitted with a self-adhesive coat on one side over its partial surface to be bonded. The total surface-weight of the coated paper or coated plastic foil is approximately 60–100 g/m$^2$. The bonding tag is not joined at its uncoated back side to the packaging-material edge zone 3. As a result the packaging sleeve now comprises a tear-open zone 8 of which the side boundaries are conceptual lines 9 in the extension of the cuts 4 at the packaging sleeve. To facilitate the tearing-open procedure, one variation of the invention provides that the seal in the junction area inside the tear-open zone 8 be in the form of a grid of lines to achieve higher peelability, i.e. provides less resistance when opening.

The projecting part 7 of the bonding tag 6 serving as the gripper tab is seized to open the package and is pulled up in the direction of the arrow 10. In the process the packaging material tears beginning at the ends of the cuts 4 approximately along the two conceptual lines 9. This tearing continues until an aperture is achieved in the packaging sleeve to take out the packaged good, without the said opening procedure destroying the structure of the packaging sleeve.

In the above described packaging material, the tearing takes place along approximately parallel lines. The patent document WO 91/06488 describes a role to select multi-layer packaging materials evincing such a property. The configuration of the invention of the bonding tag used as the gripper tab in conjunction with a packaging material satisfying this selection rule constitutes an advantageous embodiment of the packaging of the invention.

Figure 2:
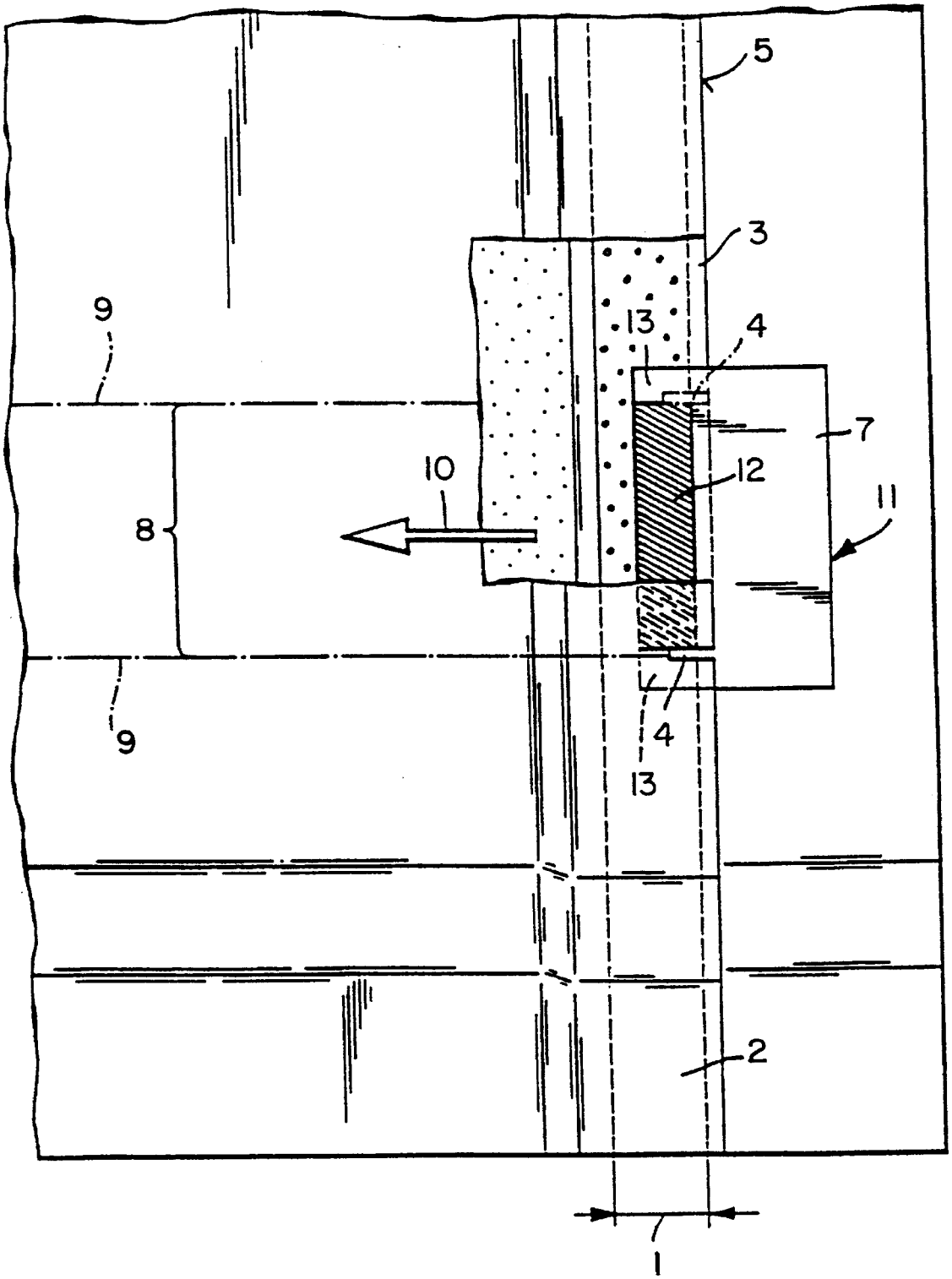
FIG. 2 is a partial top view of a modified tubular pouch packaging.

FIG. 2 shows another variation of the packaging of FIG. 1 in a partial topview, the packaging sleeve being shown broken open at the beginning of the tear-open zone 8. Contrary to the packaging variation of FIG. 1, in this case the width of the bonding tag 11 is larger than the spacing between the two cuts 4, in other words, it is wider than the tear-open zone 8. The bonding tag 11 is attached in a shaded area 12 between the two cuts 4 in FIG. 2 to the edge zone 2 and detachable in two zones 13 beyond the cuts 4, that is outside the tear-open zone 8, to said edge zone 2. During the opening procedure, the junction of the bonding tag 11 to the packaging-material edge zone 2 first is sheared off in the areas 13, and thereupon the opening takes place in the manner described in relation to FIG. 1.

Figure 3:
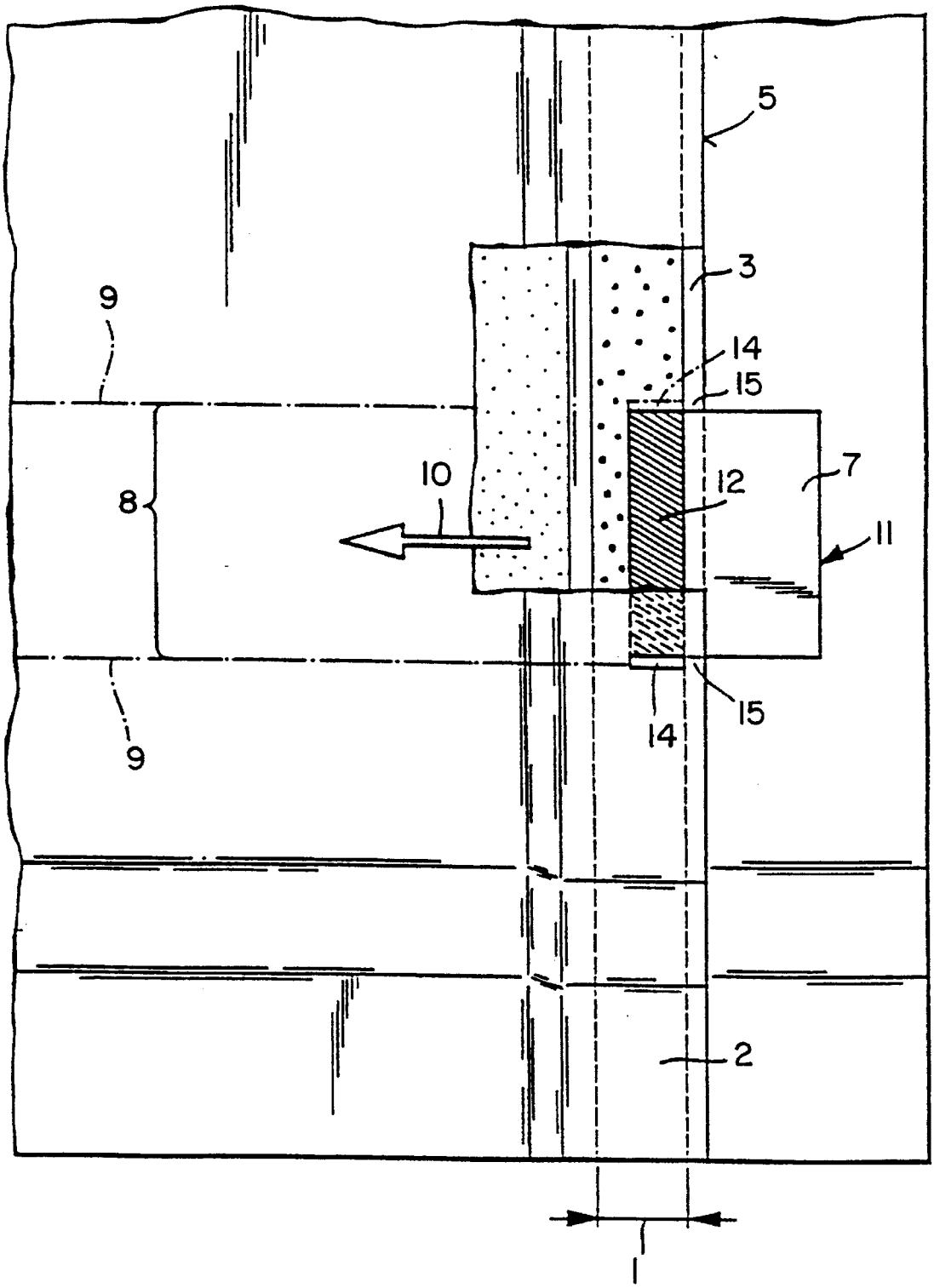
FIG. 3 is a partial top view similar to that of FIG. 2 but of a still further modified packaging.

The variation of FIG. 2 offers the advantage—especially for packaging materials with high likelihood of tearing further—that immediately after being stamped, the cuts 4 are covered by the bonding tag 11, as a result of which the danger of the packaging material tearing beyond the cuts 4 during packaging is precluded or substantially lessened.

Where packaging materials are only moderately thick, another variation shown in FIG. 3 allows replacing the cuts 4 starting at the edge 5 of the edge zone 2 with two short, linear perforations 14 that stop short of said edge 5. When opening, therefore, the remaining narrow strips 15 between the edge 5 and the perforations 14 then are merely ruptured. This design step lessens the danger that the packaging material will be torn-through when being opened.

Professional Applicability

The foremost application of the packaging of the invention is to package foodstuffs such as chocolates or cookies, said packaging where called for being hermetic and/or advantageously being in the form of tubular pouches or pouches.

I claim:

1. A packaging with a sleeve comprising a flat and foldable packaging material of which two strip-shaped edge zones are joined to each other along their inside surfaces in a junction area in order to form the said sleeve, a strip-shaped tear-open zone of the packaging sleeve starts at one of the two strip-shaped edge-zones and essentially runs transverse to said one of the two strip-shaped edge zones, said strip-shaped tear-open zone being defined by linear perforations at lateral boundaries thereof solely within the strip-shaped edge zone, and a gripping tab made of flat material that is provided between the strip-shaped edge zones and is attached to one of said edge zones at which the tear-open zone starts while being substantially detached from the other of said edge zones, said gripping tab having a residual surface that projects beyond said one of said edge zones at which the tear-open zone starts.

2. The packaging according to claim 1, wherein the gripping tab is narrower than the tear-open zone.

3. The packaging according to claim 1, wherein the gripping tab is wider than the tear-open zone and is detachable outside the tear-open zone to the said one of said edge zones where the tear-open zone starts.

4. The packaging according to claim 1, wherein the linear perforations in the said one of said edge zones where the tear-open zone starts stop short of a free edge of this edge zone.

5. The packaging according to claim 1, wherein the two strip-shaped edge zones are joined to each other by sealing of the junction area which evinces a lower peeling resistance inside the tear-open zone than in the remainder of the junction area.

6. The packaging according to claim 5, wherein the sealing of the junction area inside the tear-open zone is in the form of a grid of lines.

7. The packaging according to claim 1, wherein the packaging material is built up of several layers selected from the group consisting of paper, unstretched polyolefin foil, aluminum foil, biaxially stretched polypropylene foil, biaxially stretched polyamide foil, biaxially stretched polyethylene terephthalate foil and a sub-composite of at least two layers of the above materials, where the material which appears first in the said group is nearer the packaged good when the adjacent layers are different materials, where the layer which is to be closer to the packaged good is thinner than the other layer of the same or similar material in the packaging, and where the sub-composite is such that substantially higher adhesion is present between its layers than the adhesion between the sub-composite and the remaining layers of the packaging material.

8. A packaging with a sleeve comprising a flat and foldable packaging material of which two strip-shaped edge zones are joined to each other along their inside surfaces in a junction area in order to form the said sleeve, a strip-shaped tear-open zone of the packaging sleeve starts at one of the two strip-shaped edge-zones and essentially runs transverse to said one of the two strip-shaped edge zones, said strip-shaped tear-open zone being defined by cuts at lateral boundaries thereof solely within the strip shaped edge zone, and a gripping tab made of flat material that is provided between the strip-shaped edge zones and is attached to one of said edge zones at which the tear-open zone starts while being substantially detached from the other of said edge zones, said gripping tab having a residual surface that projects beyond said one of said edge zones at which the tear-open zone starts.

9. The packaging according to claim 8, wherein the gripping tab is narrower than the tear-open zone.

10. The packaging according to claim 8, wherein the gripping tab is wider than the tear-open zone and is detachable outside the tear-open zone to the said one of said edge zones where the tear-open zone starts.

11. The packaging according to claim 8, wherein the cuts in the said one of said edge zones where the tear-open zone starts extends to a free edge of this edge zone.

12. The packaging according to claim 8, wherein the two strip-shaped edge zones are joined to each other by sealing of the junction area which evinces a lower peeling resistance inside the tear-open zone than in the remainder of the junction area.

13. The packaging according to claim 12, wherein the sealing of the junction area inside the tear-open zone is in the form of a grid of lines.

14. The packaging according to claim 8, wherein the packaging material is built up of several layers selected from the group consisting of paper, unstretched polyolefin foil, aluminum foil, biaxially stretched polypropylene foil, biaxially stretched polyamide foil, biaxially stretched polythylene terephthalate foil and a sub-composite of at least two layers of the above materials, where the material which appears first in the said group is nearer the packaged good when the adjacent layers are different materials, where the layer which is to be closer to the packaged good is thinner than the other layer of the same or similar material in the packaging, and where the sub-composite is such that substantially higher adhesion is present between its layers than the adhesion between the sub-composite and the remaining layers of the packaging material.

15. A packaging assembly comprising:

a substantially flat packaging material including first and second longitudinally spaced strip-shaped edge portions, said packaging material being folded at longitudinally spaced intervals such that said first strip-shaped edge portion overlies said second strip-shaped edge portion transversely of said packaging material so as to define a packaging sleeve;

a strip-shaped tear-open zone defined by a pair of transversely spaced linear perforations that lie within said first strip-shaped edge portion longitudinally of said packaging material;

a gripping tab interposed between said first and second strip-shaped edge portions within said strip-shaped tear-open zone, said gripping tab including lateral portions that extend transversely beyond the pair of transversely spaced linear perforations of said strip-shaped tear-open zone respectively, said gripping tab further including a portion extending longitudinally outwardly from between said first and second strip-shaped edge portions at a position above an outer surface of said packaging material; and means for sealingly connecting said first strip-shaped edge portion to said second strip-shaped edge portion along substantially the entire transverse length of said packaging material, said gripping tab being interposed between said sealing connecting means and said second strip-shaped edge portion within said strip-shaped tear-open zone such that said gripping tab is attached to said first strip-shaped edge portion by said sealing connecting means within said strip-shaped tear-open zone while said gripping tab is detached from said second strip-shaped edge portion.

16. The packaging assembly according to claim 15, wherein said sealingly connecting means does not extend between the lateral portions of said gripping tab and said first strip-shaped edge portions.

17. A packaging assembly comprising:

a substantially flat packaging material including first and second longitudinally spaced strip-shaped edge portions, said packaging material being folded at longitudinally spaced intervals such that said first strip-shaped edge portion overlies said second strip-shaped edge portion transversely of said packaging material so as to define a packaging sleeve;

a strip-shaped tear-open zone defined by a pair of transversely spaced cuts that lie within said first strip-shaped edge portion longitudinally of said packaging material;

a gripping tab interposed between said first and second strip-shaped edge portions within said strip-shaped tear open zone, said gripping tab including lateral portions that extend transversely beyond the pair of transversely spaced cuts of said strip-shaped tear-open zone respectively, said gripping tab further including a portion extending longitudinally outwardly from between said first and second strip-shaped edge portions at a position above an outer surface of said packaging material; and means for sealingly connecting said first strip-shaped edge portion to said second strip-shaped edge portion along substantially the entire transverse length of said packaging material, said gripping tab being interposed between said sealing connecting means and said second strip-shaped edge portion within said strip-shaped tear-open zone such that said gripping tab is attached to said first strip-shaped edge portion by said sealing connecting means within said strip-shaped tear-open zone while said gripping tab is detached from said second strip-shaped edge portion.

18. The packaging assembly according to claim 17, wherein said sealingly connecting means does not extend between the lateral portions of said gripping tab and said first strip-shaped edge portion.

* * * * *